US008014553B2

(12) United States Patent
Radivojevic et al.

(10) Patent No.: US 8,014,553 B2
(45) Date of Patent: Sep. 6, 2011

(54) EAR-MOUNTED TRANSDUCER AND EAR-DEVICE

(75) Inventors: Zoran Radivojevic, Helsinki (FI); Matti Hämäläinen, Lempäälä (FI); Lauri Wirola, Tampere (FI); Ville Myllylä, Tampere (FI); Shinya Terasaki, Tokyo (JP)

(73) Assignee: Nokia Corporation, Espoo (FI)

( * ) Notice: Subject to any disclaimer, the term of this patent is extended or adjusted under 35 U.S.C. 154(b) by 1338 days.

(21) Appl. No.: 11/594,704

(22) Filed: Nov. 7, 2006

(65) Prior Publication Data

US 2008/0192961 A1 Aug. 14, 2008

(51) Int. Cl.
*H04R 25/00* (2006.01)

(52) U.S. Cl. ..... 381/380; 381/151; 381/326

(58) Field of Classification Search ..... 381/151, 381/326, 380; 600/379; 607/136–137
See application file for complete search history.

(56) References Cited

U.S. PATENT DOCUMENTS

| | | | | |
|---|---|---|---|---|
| 4,025,734 | A * | 5/1977 | Aloupis | 381/151 |
| 5,692,059 | A * | 11/1997 | Kruger | 381/151 |
| 5,933,506 | A * | 8/1999 | Aoki et al. | 381/151 |
| 6,463,157 | B1 | 10/2002 | May | |
| 7,433,484 | B2 * | 10/2008 | Asseily et al. | 381/355 |
| 2005/0027515 | A1 | 2/2005 | Huang et al. | |
| 2005/0033571 | A1 | 2/2005 | Huang et al. | |
| 2006/0159297 | A1 | 7/2006 | Wirola et al. | |
| 2007/0086600 | A1 * | 4/2007 | Boesen | 381/79 |

FOREIGN PATENT DOCUMENTS

| | | |
|---|---|---|
| EP | 1 320 282 A2 | 6/2003 |
| JP | 02002125298 | 4/2002 |
| WO | WO/02/07477 | 1/2002 |
| WO | WO/02052890 | 7/2002 |
| WO | WO/2004/066669 | 8/2004 |

* cited by examiner

*Primary Examiner* — Davetta Goins
*Assistant Examiner* — Matthew Eason

(57) ABSTRACT

The specification and drawings present a new method, apparatus and software product for providing flexible audio communication solutions using ear-devices utilizing, e.g., electrode transducers with one or more sensors comprising a surface resonator cavity sensitive to a predetermined acoustic frequency range for using, for example, in headsets and hearing aids. The ear-device can be configured for inserting it into a human ear for a handsfree operation and the sensors can be configured to detect human tissue vibrations using the surface resonator cavity. The acoustic communication solutions with these ear-devices may include: providing two-way communications in normal conditions as well as in noisy conditions, providing protection of hearing, recording the true sound field bin-aurally, providing a playback capability, providing volume enhancement and equalization for persons with hearing defects, etc.

44 Claims, 9 Drawing Sheets

EAR-MOUNTED TRANSDUCER AND EAR-DEVICE

TECHNICAL FIELD

The present invention relates generally to communication devices and more specifically, to integrated ear-devices for providing acoustic communication solutions.

BACKGROUND ART

Novel multimedia devices are having multifunction applications. Phones and multimedia devices are used for connecting, finding, storing and spreading information via digital or audio channels (speech and listening). Such portable devices are used in different environments such as offices, silent cabinets, hospitals, metro, public but quiet places, etc., or in more noisy conditions as noisy streets, riding motorbike, etc. To satisfy sufficient quality of communications in all of these conditions the audio system has to provide a "silent input method" (do not disturb your environment while communicating) or it has to cancel noise from the surrounding environment (noise cancellation). The quality of communications is directly related to use conditions and limitations set by an audio-digital-audio signal conversion mechanism. Versatile usage conditions are difficult to cover by using present technical solutions for digital audio communications, which limits quality of information exchange and user satisfaction by products and services.

To improve audio conversion mechanisms, different technologies have been used. An example of a relatively new and direct conversion mechanism which avoids the air as sound wave propagation medium is a Silent Violin where vibrations from the wires are propagated through solid materials towards an ADC (analog-to-digital converter) for converting to a digital signal, which is then amplified and finally released into the air providing a beautiful sound quality.

Hardware (HW) miniaturization trends put size limits on both microphones and speakers challenging the quality of audio communications. Usually an audio signal propagates from the user's mouth to the air, to a microphone "listening" the air and then digitally converted and electrically amplified and finally spread into the air (e.g., by a speaker). The air is not the best medium for propagation of sound waves. Furthermore, the air is usually full of different sounds (noises) which are not useful while communicating by the portable electronic equipment. The air (gas mixture) is not the best medium, solid and liquid state materials are much more efficient in sound propagation. Moreover, the audio signal in the air has large dissipation requiring the user to speak relatively loudly to achieve a good quality of the audio communication. Therefore, a direct coupling of a microphone to a user body (avoiding the air) can present a very advanced solution for silent and not disturbing communications, such that the user does not disturb the environment while speaking (high sensitivity level) and the user is not disturbed by the environmental conditions (noise free communication).

Ordinary handsfree modules and hearing aids are very useful modules/gadgets. On the other hand, people do not like carrying separate modules while commuting and travelling. At the present, high-level integration technologies can provide a single small device which might be hosted at an external electronic device (e.g., mother phone).

In the available hands-free solutions, the background noise is clearly hearable to the receiver of the call. Certain algorithms are utilized in the noise reduction, but they can generally reduce the noise level only by 10-15 dB. However, the mobile devices are also used in circumstances, in which the noise level is high compared to the speech level. This poses a problem for the current sensor solutions (traditional pressure microphones) and, also, for actuator solutions (traditional loudspeakers). Moreover, often the users wish to protect their hearing under such conditions. For such protection either circumaural or insert-type ear-defenders are used. In both cases, the protection solution further complicates or prohibits the communication.

DISCLOSURE OF THE INVENTION

According to a first aspect of the invention, an apparatus, comprises: an electrode transducer, comprising at least one sensor, the at least one sensor comprising a surface resonator cavity sensitive to a predetermined acoustic frequency range, wherein the apparatus is configured for inserting it into a human ear for a handsfree operation and the at least one sensor is configured for detecting human tissue vibrations using the surface resonator cavity.

According further to the first aspect of the invention, the electrode transducer may comprise one or more sensors of the at least one sensor with one of: a) a capacitive detection mechanism, b) a piezoelectric detection mechanism, and c) a detection mechanism utilizing miniature accelerator meters. Further, each of the plurality of sensors may be optimized for a different acoustic frequency range. Further still, the electrode transducer may comprise a soft material between the sensors for adapting to the human ear.

According further to the first aspect of the invention, the at least one sensor may have a shape of a ring, line or a spiral shape.

Still further according to the first aspect of the invention, the electrode transducer may be configured for a speech detection by detecting the human tissue vibrations.

According further to the first aspect of the invention, the apparatus may further comprise an impedance-matching layer covering the at least one sensor for efficient and gentle acoustic coupling of the segmented sensors to the human ear. Further, when the apparatus is attached to an electronic device, the at least one sensor may be disengaged from a contact with the impedance-matching layer.

According still further to the first aspect of the invention, the apparatus may further comprise: a microphone, for detecting acoustic vibrations, wherein the apparatus is configured to adjust a sensitivity level or a sensitivity ratio of:

a) detecting the human tissue vibrations by the electrode transducer, and b) detecting the acoustic vibrations by the microphone.

According still further to the first aspect of the invention, the apparatus may further comprise: a speaker, for providing an acoustic signal. Further, the speaker may be configured to adjust a volume of the acoustic signal coupled to the human ear. Further still, the speaker may be configured to adjust spectral content of the acoustic signal coupled to the human ear. Further still, the microphone may be configured to provide at least one of: a) a two-way communication in normal or noisy conditions, b) bin-aural recording, c) a hearing protection for the human ear from external noises, d) volume enhancement and equalization as a hearing aid, and e) a playback capability in the normal or noisy conditions.

According yet further still to the first aspect of the invention, the apparatus may further comprise an electronic processing module for supporting functionalities of all or selected components of the apparatus.

Yet still further according to the first aspect of the invention, the processing module may be configured to perform a decoding process such that the apparatus is further configured to provide media player capabilities.

Still yet further according to the first aspect of the invention, the apparatus may further comprise at least one of: a) a battery for supporting an operation of all components of the apparatus requiring an electric power, and b) a memory for storing recorded files.

Still further still according to the first aspect of the invention, the apparatus may be a part of an electronic device and may be configured for detaching from the electronic device for the inserting into the human ear and for attaching back to the electronic device. Further, the apparatus, when attached to the electronic device, may be configured to provide a further handsfree operation. Further still, the apparatus may comprise a battery and the electronic device may be configured to recharge the battery when the apparatus is attached to the electronic device.

According further still to the first aspect of the invention, the apparatus may be connected to an electronic device and the apparatus may further comprise a wireless module for providing a wireless communication of the apparatus with the electronic device, or the apparatus may be connected by a wire to the electronic device. Further, the electronic device may be a wireless device, a portable communication device, a personal digital assistant or a mobile phone.

According yet further still to the first aspect of the invention, the apparatus may be configured to operate without external assistance.

According to a second aspect of the invention, an electrode transducer, comprises: at least one sensor, which comprises a surface resonator cavity sensitive to a predetermined acoustic frequency range, wherein the at least one sensor, when inserted into a human ear for a handsfree operation, is configured to detect human tissue vibrations using the surface resonator cavity.

According further to the second aspect of the invention, the electrode transducer may comprise one or more sensors of the at least one sensor with one of: a) a capacitive detection mechanism, b) a piezoelectric detection mechanism, and c) a detection mechanism utilizing miniature accelerator meters.

Further according to the second aspect of the invention, each of the plurality of sensors may be optimized for a different acoustic frequency range.

Still further according to the second aspect of the invention, the electrode transducer may comprise a soft material between the sensors for adapting to the human ear.

According further to the second aspect of the invention, the at least one sensor may have a shape of a ring, line or a spiral.

According to a third aspect of the invention, a method, comprises: inserting an ear-device into a human ear for a handsfree operation, wherein the ear-device comprises: an electrode transducer comprising at least one sensor, the at least one sensor comprising a surface resonator cavity sensitive to a predetermined acoustic frequency range; and detecting by the at least one sensor human tissue vibrations using the surface resonator cavity.

Further according to the third aspect of the invention, the ear-device may further comprise a microphone, and the method may further comprise: detecting acoustic vibrations using the microphone, wherein the ear-device is configured to adjust a sensitivity level or a sensitivity ratio of: a) detecting the human tissue vibrations by the electrode transducer, and b) detecting the acoustic vibrations by the microphone.

Still further according to the third aspect of the invention, the ear-device may further comprise a speaker providing an acoustic signal, and the method may further comprise: adjusting at least one of: a) a volume of the acoustic signal coupled to the human ear, and b) spectral content of the acoustic signal coupled to the human ear.

According further to the third aspect of the invention, the method may further comprise: taking the ear-device out of the human ear and attaching the ear-device to an electronic device for a further handsfree operation or for recharging a battery of the ear-device.

According still further to the third aspect of the invention, the ear-device may further comprise a wireless module, and the method may further comprise: providing a wireless communication of the ear-device with the electronic device.

According yet further still to the third aspect of the invention, the microphone may be configured to provide at least one of: a) two-way communications in normal or noisy conditions, b) bin-aural recording, c) a hearing protection for the human ear from external noises, d) volume enhancement and equalization as a hearing aid, and d) a playback capability in the normal or noisy conditions.

According further still to the third aspect of the invention, the electrode transducer may comprise one or more sensors of the at least one sensor with one of: a) a capacitive detection mechanism, b) a piezoelectric detection mechanism, and c) a detection mechanism utilizing miniature accelerator meters. Further, each of the plurality of sensors may be optimized for a different acoustic frequency range.

Yet still further according to the third aspect of the invention, during the detecting, the surface resonator cavity may be located substantially in a vicinity of a human tissue but without a direct physical contact with the human tissue.

According to a fourth aspect of the invention, a computer program product comprises: a computer readable storage structure embodying computer program code thereon for execution by a computer processor with the computer program code, wherein the computer program code comprises instructions for performing the third aspect of the invention, indicated as being performed by any component or a combination of components of the ear-device or an electronic device connected to the ear device using a wireless or non-wireless method.

According to a fifth aspect of the invention, a system, comprises: at least one ear-device, comprising:

an electrode transducer comprising at least one sensor, the at least one sensor comprising a surface resonator cavity sensitive to a predetermined acoustic frequency range, wherein the apparatus is configured for inserting it into a human ear for a handsfree operation and the at least one sensor is configured for detecting human tissue vibrations using the surface resonator cavity; and an electronic device, for providing communicating acoustically generated signals to and from the ear-device.

According further to the fifth aspect of the invention, the system may further comprise: a microphone, for detecting acoustic vibrations, wherein the apparatus is configured to adjust a sensitivity level or a sensitivity ratio of:

a) detecting the human tissue vibrations by the electrode transducer, and b) detecting the acoustic vibrations by the microphone; and a speaker, for providing an acoustic signal. Further, the at least one ear-device may comprise two ear-devices and the two ear-devices, when inserted into both human ears, may be configured for at least one of:

a) to provide bin-aural recording, b) to provide a hearing protection for the human ears from external noises; and c) to provide an adjustable hearing protection for the human ears from external noises.

Further according to the fifth aspect of the invention, the at least one ear-device may comprise a battery for supporting an operation of all components of the ear-device requiring an electric power, and the electronic device may be configured for recharging the battery.

Still further according to the fifth aspect of the invention, during the detecting, the surface resonator cavity may be located substantially in a vicinity of a human tissue but without a direct physical contact with the human tissue.

According to a sixth aspect of the invention, an apparatus, comprises: transducer means, comprising at least one sensor, the at least one sensor comprising a surface resonator cavity sensitive to a predetermined acoustic frequency range, wherein the apparatus is configured for inserting it into a human ear for a handsfree operation and the at least one sensor is configured for detecting human tissue vibrations using the surface resonator cavity.

According further to the sixth aspect of the invention, the transducer means may be an electrode transducer.

BRIEF DESCRIPTION OF THE DRAWINGS

For a better understanding of the nature and objects of the present invention, reference is made to the following detailed description taken in conjunction with the following drawings, in which.

MODES FOR CARRYING OUT THE INVENTION

Figure 1:
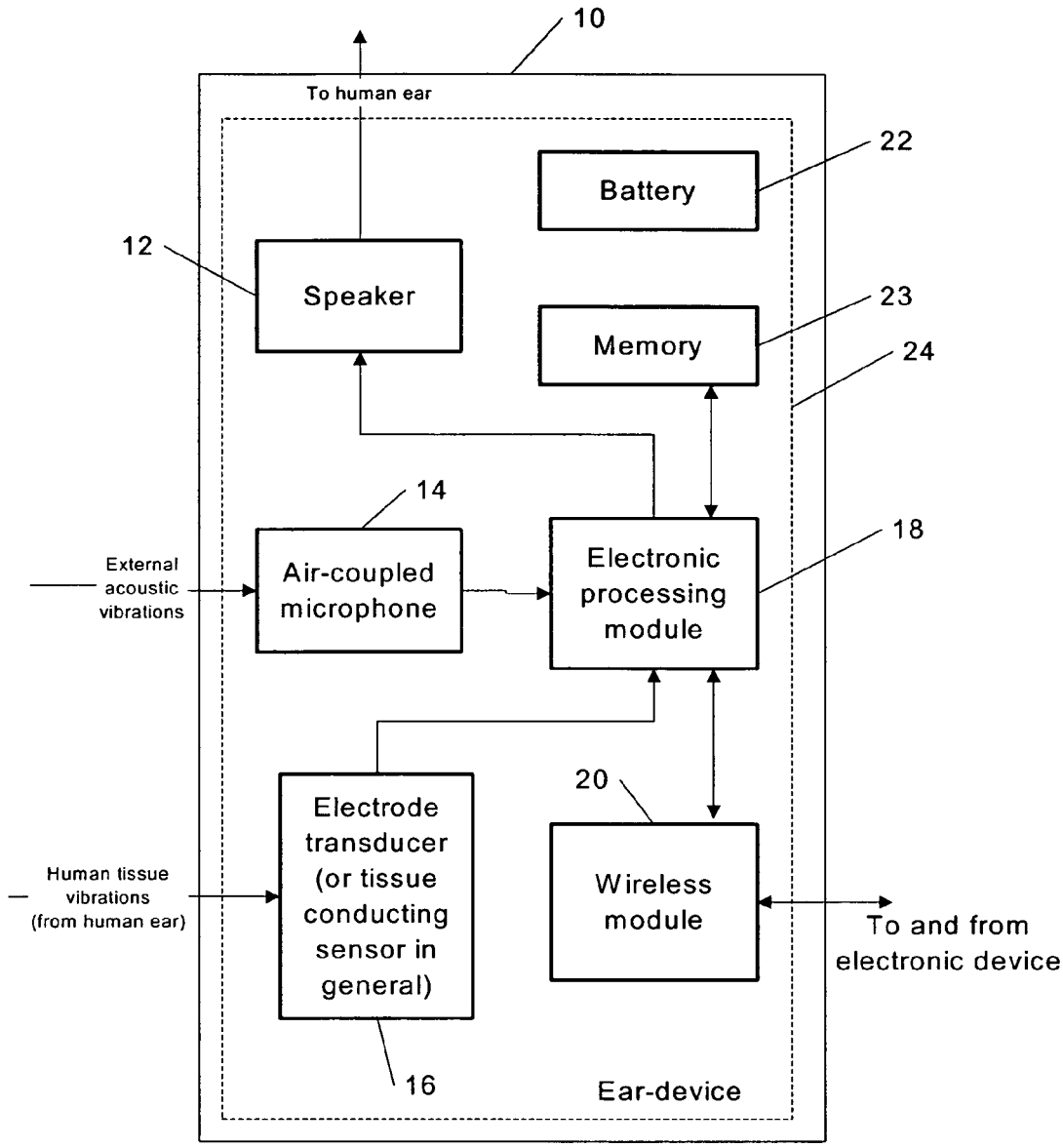
FIG. 1 is a block diagram of an ear-device, according to an embodiment of the present invention.

A new method, apparatus and software product for providing flexible audio communication solutions using ear-devices (for example, multifunctional and integrated ear-devices) utilizing, e.g., electrode transducers with at least one sensor (i.e., it could be one or more sensors) comprising a surface resonator cavity sensitive to a predetermined acoustic frequency range for using, for example, in headsets and hearing aids. The ear-device can be configured for inserting it into a human ear for a handsfree operation and the at least one sensor can be configured to detect human tissue vibrations using said surface resonator cavity (surface resonator cavity can be located, e.g., in a vicinity of a human tissue with some or without a direct physical contact with said human tissue).

According to embodiments of the present invention, the acoustic communication solutions utilizing multifunctional integrated ear-devices described herein, may include (but are not limited to): providing two-way communications in normal conditions as well as in noisy conditions, providing protection of hearing, recording the true sound field bin-aurally, providing a playback capability, providing volume enhancement and equalization for persons with hearing defects, etc. According to various embodiments, the ear-device can operate by itself or it can be attached to a portable communication device like a mobile phone.

According to an embodiment of the present invention, an ear-device can comprise all or a combination of the following components: a tissue conducting sensor such as the electrode transducer (e.g., using a single sensor or a plurality of segmented sensors) for detecting human tissue vibrations, a microphone (e.g., an air-coupled microphone) for detecting primarily external acoustic vibrations, a speaker for providing an acoustic signal, and a housing for holding the tissue conducting sensor, the air-coupled microphone and the speaker and for inserting into a human ear for a handsfree operation of the ear-device. According to further embodiments, a sensitivity level or a sensitivity ratio of: a) detecting the human tissue vibrations using the tissue conducting sensor such as the electrode transducer, and b) detecting the acoustic (external) vibrations using the microphone, can be adjusted. Furthermore, a volume and a frequency content of the acoustic signal coupled to said human ear by the speaker can be also adjusted, e.g., by using the plurality of sensors optimized for different frequency ranges. Also using multiple (segmented) sensors can cover more area of the human tissue and improve sensitivity of detection.

According to a further embodiment, the ear-device can comprise an electronic processing module (e.g., digital signal processor) for supporting functionalities of the tissue conducting sensor, the microphone and the speaker. Alternatively a memory module can be included in the ear-device if data storage is required. Moreover, the ear-device can have a battery for supporting an operation of all components of the ear-device requiring an electric power (alternatively the ear-device can have a wiring connection to the external electronic device or another electric power source).

Typically, the ear-device can be a part of an external electronic device (e.g., a mobile phone) and can be configured for detaching from the electronic device for inserting into the human ear and for attaching back (e.g., using a magnetic structure, snaps, etc.) to said electronic device, e.g., for recharging the battery. In one embodiment, when attached to the electronic device, the ear-device can be configured to provide the handsfree operation with more details provided in regard to FIG. 4*a*. Moreover, the ear-device can comprise a wireless module (e.g., BLUETOOTH, radio transmitter/receiver, etc.), for providing a wireless communication with the electronic device. Alternatively, the ear-device and the electronic device can have a connection through a non-wireless (e.g., cable) connection.

FIGS. 1, 2*a*, 2*b*, 3 and 4*a* show examples among others of schematic representations for an ear-device 10, according to embodiments of the present invention.

FIG. 1 shows an example among others of a block diagram of the ear-device 10, according to an embodiment of the present invention. The ear-device 10 can comprise a housing 24 holding other modules: an electrode transducer (or in general a tissue conducting sensor) 16, a microphone 14, a speaker 12, an electronic processing block (e.g., a digital signal processor), a battery 22 and a wireless module 20. The electrode transducer 16, according to embodiments of the present invention, is described in more detail in regard to FIGS. 4*a* through 4*c*.

The tissue conducting sensor 16 can comprise of a plurality of segmented sensors 16*a* (e.g., see FIGS. 2*a* and 2*b*, or having a ring shape), each of these segmented sensors 16*a* can be optimized for a different frequency range. The sensor 16 can be primarily used for picking up the user's own speech (and/or other sounds associated with human movement such as, for instance, tapping or knocking) and may be realized, besides electrode transducer implementation disclosed in regard to FIGS. 4*a*-4*b*, by using e.g., piezoelectric benders or other technologies. These segmented sensors can respond to tissue vibrations. The benders may be located at the outer surface of the circularly shaped device (see FIG. 2*b*), e.g., on a outer surface of the housing 24. The sensors (including electrode transducers described herein) can be coated with a soft and comfortable impedance-matching layer 25 (for efficient and gentle coupling to an interior user ear), such as presented in International Patent application WO2004066669A2, "Anisotropic Acoustic Impedance Matching Material" by M. C. Bhardwaj. Also, the matching layer can be made of other suitable materials, e.g., a silicone rubber (soft elastic rubber). Piezoelectric components may also need an FET (field-effect transistor) at the electrodes of segmented sensors for electric impedance matching. Other methods which can be used for implementing the sensor 16 can include (but are not limited to) using: a capacitive method (e.g., used in electrode transducers of FIGS. 4*a*-4*c*), miniature accelerator meters, etc.

Figure 2A:
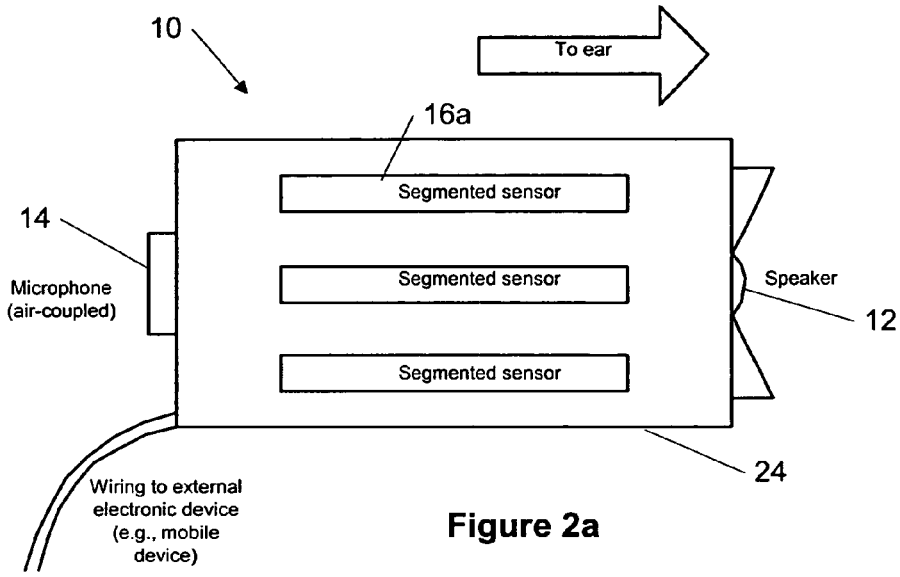
FIGS. 2*a* and 2*b* are schematic representations (a side view and a 3-dimensional view), respectively, of an ear-device, with one end that is located inside an ear canal having a miniature speaker, another end having a microphone and having the tissue conducting sensors on the outer surface, according to an embodiment of the present invention.
Figure 2B:
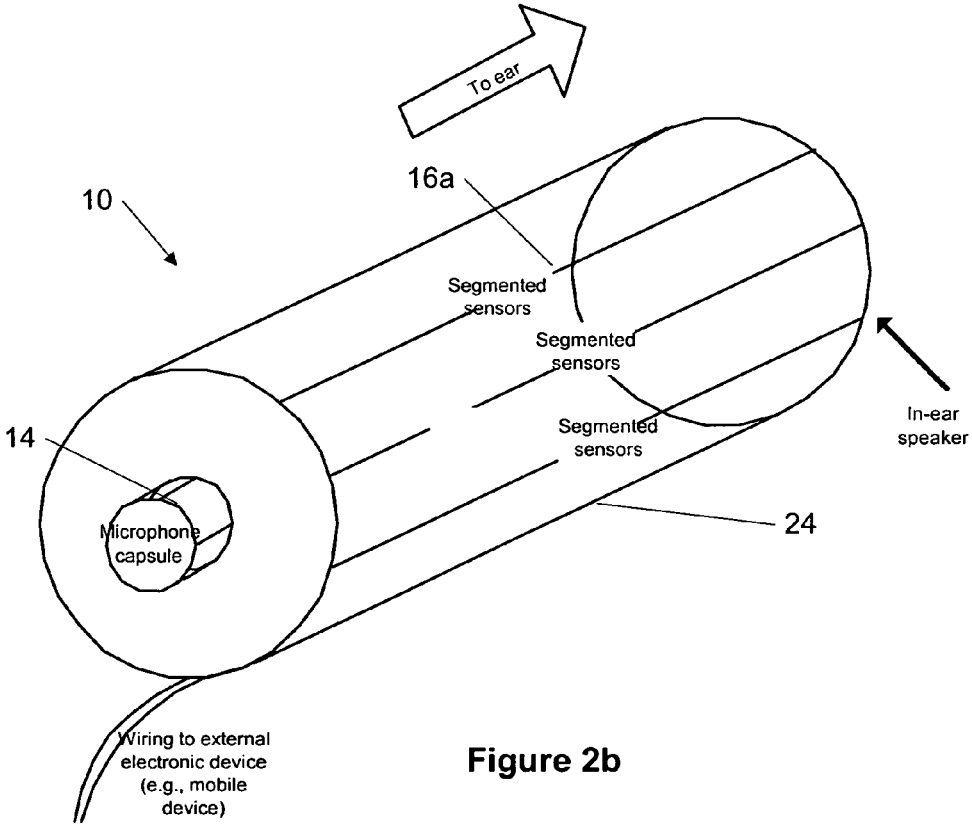

The microphone 14 and the speaker 12 may be of a standard type and can be located at the ends (e.g., opposite ends) of the ear-device (e.g., see FIGS. 2*a* and 2*b*). FIGS. 2*a* and 2*b* show an example among many others of schematic representations (a side view and a 3-dimensional view), respectively, of the ear-device 10 of a round shape, with one end that is located inside the ear canal having a miniature speaker 12 and having the tissue conducting sensors 16*a* on the outer surface with a microphone 14 on the other end, according to an embodiment of the present invention. It should be noted that the FIGS. 2*a* and 2*b* are exemplary only and do not necessarily represent the final implementation. The speaker 12 and the microphone 14 may, for instance, be located at the same end. In such a case the audio signal can be fed to the human ear canal via a narrow tube through the device structure.

The microphone 14 can be used for picking up the external sounds. In addition, it may be used together with the tissue conducting sensor 16 for picking up the user's speech and/or to improve overall frequency response. It is known that the sensor 16 can work in a fairly narrow frequency range (e.g., in the range 2.5-3 kHz). A conventional microphone 14 may then be used to complement the frequency range up to the desired frequency, e.g., by simultaneously using the microphone 14 and the sensor 16. Another alternative for detecting a wider frequency range would be to optimize each of these segmented sensors 16*a* for different acoustic frequencies complimentary to each other (this can be also in addition to using the microphone 14).

Figure 3:
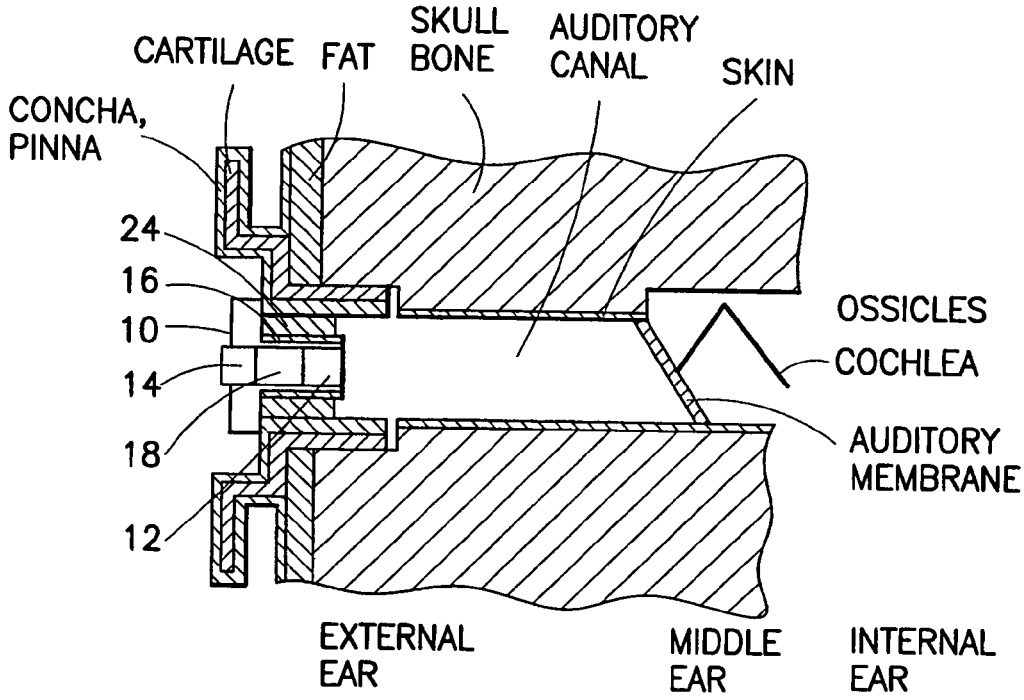
FIG. 3 is a schematic representation of an ear-device inserted into a human ear, according to an embodiment of the present invention.

The speaker 12 radiates an acoustic wave into the human ear canal. Due to a low acoustic leak in the system (the speaker 12 can be in close proximity to the ear canal as shown in FIGS. 2*a*, 2*b* and 3 and its acoustic patent can be directional), the base response can be made excellent. The current hands-free solutions do have problems with the low-frequency response, but the solution described herein can solve the frequency response problem as well.

Figure 6:
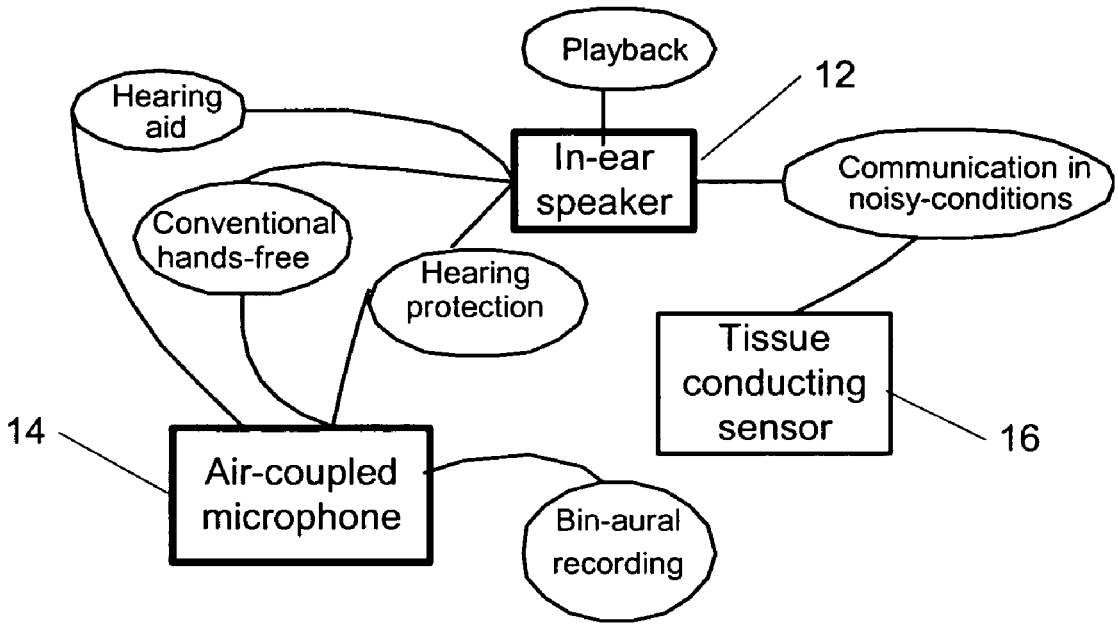
FIG. 6 is a diagram demonstrating different applications utilizing an ear-device used for different applications described herein, showing individual components (rectangles) of an ear device utilized for different functionalities (ellipses), according to embodiments of the present invention.

The electronic processing module 18 (e.g., a digital signal processor) can be included in the ear-device 10 to perform some signal processing to support various functionalities, which are discussed in more detail in regard to FIG. 6. The required processor may, for instance, be located in the center of the ear-device 10 (see FIG. 3). Power for the processing module 18 can be drawn from the battery 22 or externally, e.g., the mobile device (then there is no own battery in the ear-device 10). Alternatively, the ear-device 10 may solely rely on the processor located in the mobile device or on a combination of both processors (could be a more cost-effective solution). The module 18 can be responsive to commands from the user (e.g., through a user interface implemented in the mobile device or possibly in the ear-device 10) to set and/or change functionalities and performance characteristics of the modules 12, 14 and 16 for a specific application (see FIG. 6). According to an embodiment of the present invention, the block 18 can be implemented as a software or hardware module or a combination thereof. Furthermore, the block 18 can be split into several blocks according to their functionality. The ear-device 10 can also have a memory 23 for storing, e.g., recorded information and/or music files.

The shape of the ear-device 10 can be circular, conical, U-shape, etc., or custom tailored to a particular user in order to properly fit in the human ear canal. The device may also include an easy-to-use method for inserting the device into the ear. The method of insertion is important from the usability point of view. An example showing the ear-device 10 inserted into the human ear is shown in FIG. 3.

Figure 4A:
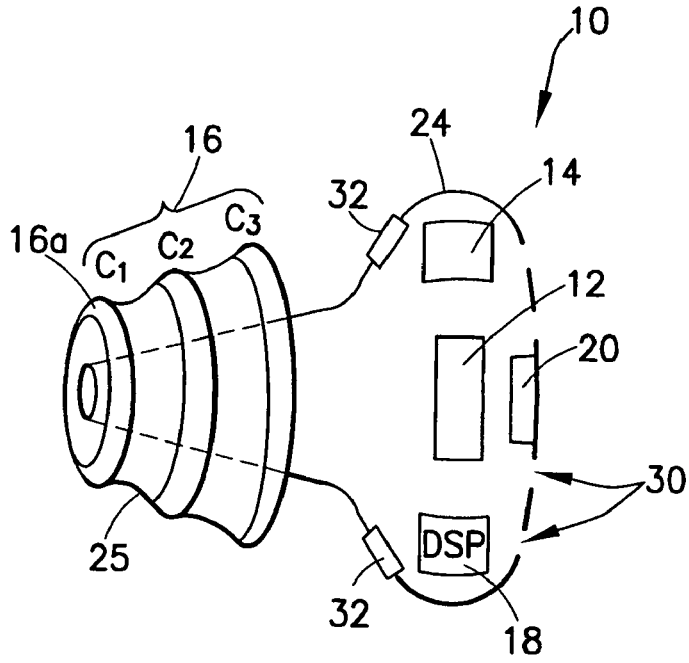
FIG. 4*a* through 4*e* are schematic representations of a block diagram of an ear-device with a conical shape tissue conducting sensor (FIG. 4*a*) showing a structure of a segmented ring sensor (FIG. 4*b*) and a spiral construction (FIG. 4*c*), according to an embodiment of the present invention.
Figure 4B:
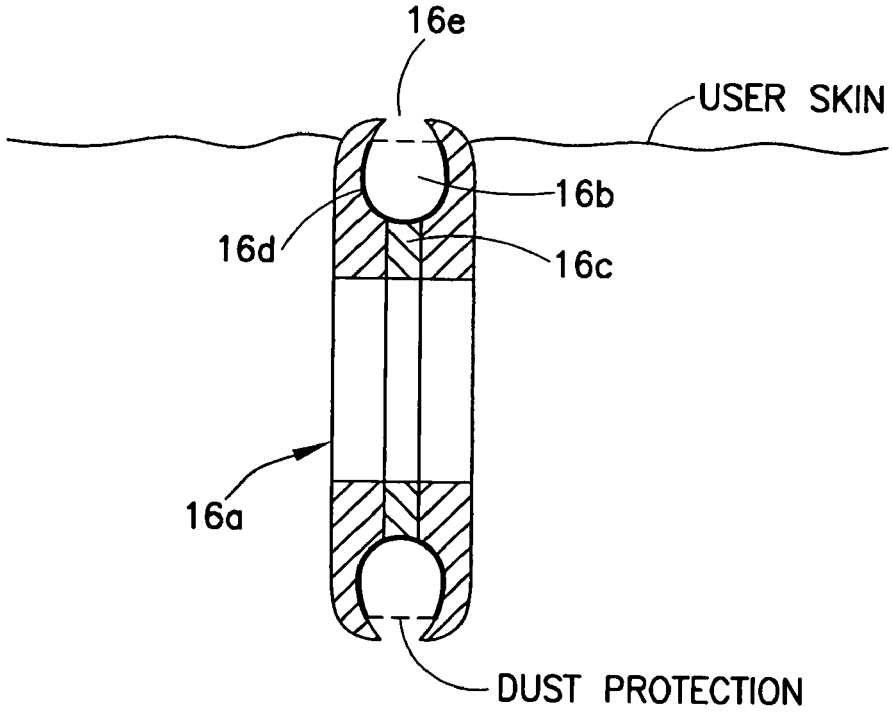
Figure 4C:
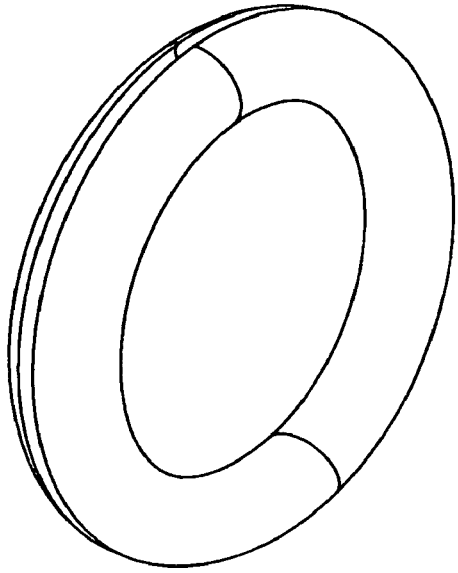
Figure 4D:
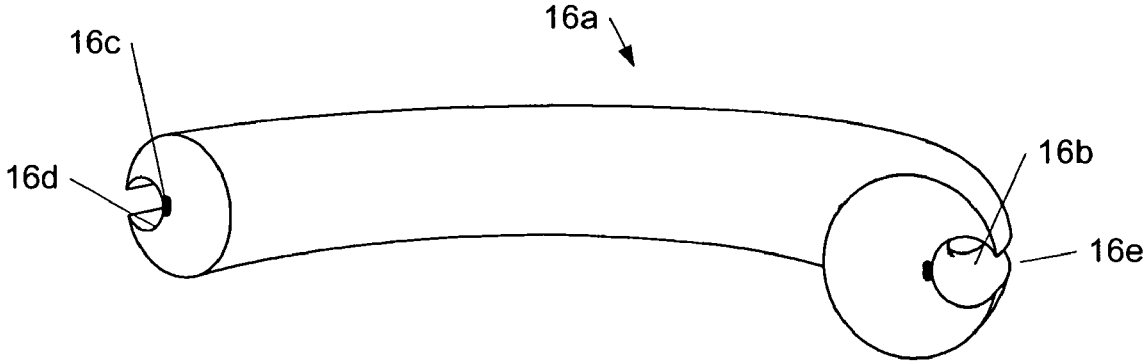
Figure 4E:
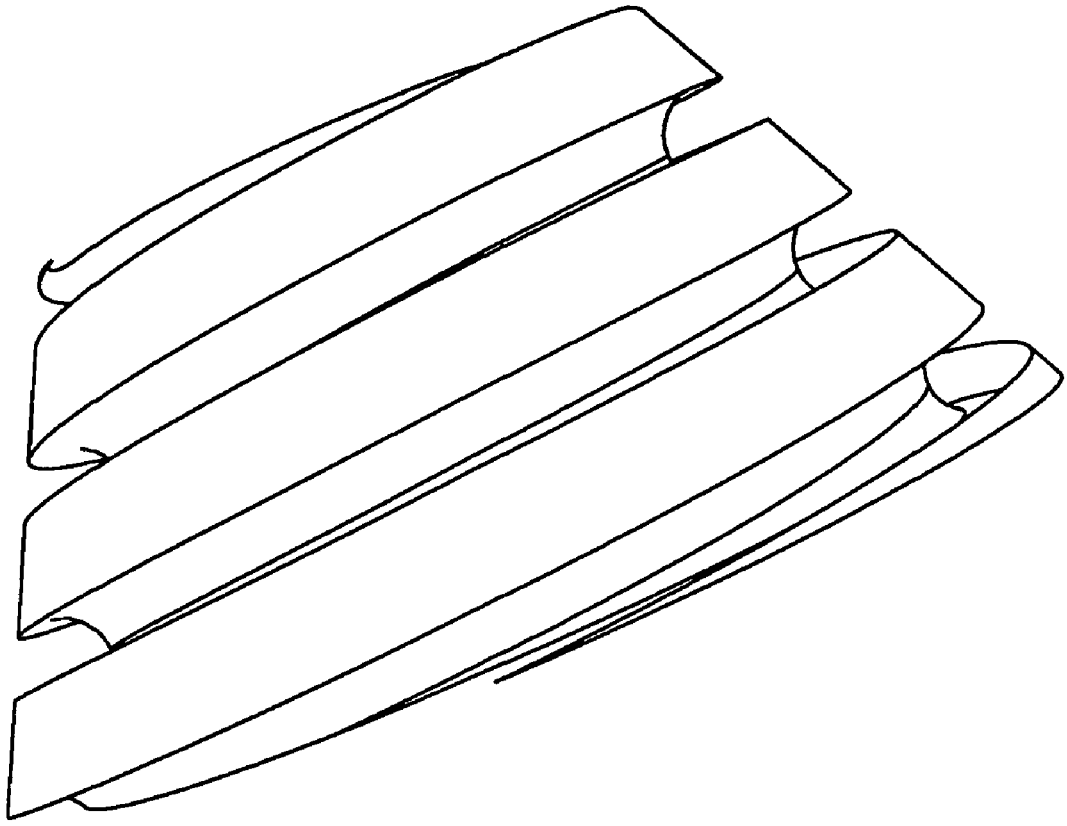

FIG. 4*a* shows a further example among others of a schematic representation of the ear-device 10 with a conical shape electrode transducer 16 with, e.g., a capacitive detection mechanism (other mechanisms, such as piezoelectric or utilizing miniature accelerator meters as described herein, can be also used), according to a further embodiment of the present invention. In this example the ear-device 10 can serve two operational modes: when attached to the external electronic device (phone) 40 (see FIG. 5, as further discussed below), as ordinary mode (OM), and when detached and placed into the human ear in a handsfree tissue mode (HTM) as an autonomous miniaturized device. When in the OM, the microphone can "listen" the air using the air coupled microphone 14 and also possibly using the electrode transducer 16 (which is primarily for tissue conducting detection) as well. In the latter case, a plurality of sensors 16*a* which are parts of, e.g., the electrode transducer (capacitive sensor) 16 can be decoupled from the soft layer 25 (e.g., a soft elastic rubber) to provide good sensitivity to the air. In FIG. 4*a*, the segments (capacitive electrodes) 16*a* have a shape of a ring and can be made of a magnetic material as shown in more detail in FIG. 4*b* with a sensor surface area 16*d* comprised of a resonator cavity 16*b* with an opening 16*e* towards the skin. The segmented sensors 16*a* (shown as C1, C2 and C3 in FIG. 4*a*) can be optimized to work in different frequency ranges (e.g., 300 Hz<C3<500 Hz, 500 Hz<C2<1 kHz, 2 kHz<C1<7 KHz, etc.) for providing wider overall frequency range. The surface resonator cavity 16*b* can be sensitive to a predetermined acoustic frequency range and couple its vibrations through a capacitive change to an electrode (e.g., metallic) 16*c* of a ring shape. The frequency response of the sensor 16*a* can depend (among other factors) on sensor dimensions, location, geometry, mechanics (e.g., diameter of the ring, size/shape of the resonator cavity, ratio of the opening 16*e* and the sensor surface area 16*d*, etc.). The surface resonator cavity 16*b* can be located, e.g., in a vicinity of a human tissue without a direct physical contact with said human tissue or with a partial physical contact (e.g., through the soft layer 25). The resonator transducer 16 can perform as an acoustic mass-spring system having desired filtering characteristics. FIGS. 4*c* and 4*d* show 3-dimensional views of a ring (segmented sensor) 16*a*. FIG. 4*e* demonstrates a spiral implementation of the sensor 16*a*. Other implementations of the sensor 16*a* (e.g., a simple line) can be used.

When the ear-device 10 is in the HTM detached from the mother-phone 40 and placed into the user ear, the capacitive sensors 16*a* are coupled to the soft embodiment and further to the interior user ear to provide direct coupling to the human tissue. For example, the change of status of the sensor 16*a* can be made by having small magnets 48 in a mother-phone 40 (see FIG. 5) which will lift up the capacitive electrode 16*a* (made of the magnetic material) from the soft layer 25 when the ear-device 10 is at the mother-phone 40 by making a connection of the detaching/attaching contacts 32 with the magnets 48. The magnets 48 may be integrated into a mother-phone holding part and when the ear-device 10 is placed at the phone 40, the electrodes 16*a* are decoupled and the sensor 16 can "listen" the air. The sensors/electrodes of the capacitive electrode transducer 16 can have a cylindrical shape to provide passing through capability of the audio signals as well.

The modules 12, 14, 18 and 20 shown in FIG. 4*a* are described in detail in regard to FIGS. 1, 2*a*, 2*b* and 3. However, the ear-device 10 in FIG. 4*a* includes a miniaturized speaker 12 placed at the side of the device 10 furthest from the human ear. Since the electrode transducer 16 has, e.g., the conical shape among other options, the sound generated by the speaker 12 in FIG. 4*a* can pass through to the human ear. Such combination of miniaturized mechanisms and sensors can provide a portable device Phone-Hosted Detachable Tissue conducting Microphone-Speaker Handsfree module (PHMS). Such PHMS device module may be hosted at the phone (portable device), detached and placed into the human ear when the user needs, e.g., "silent communications" or other applications described in regard to FIG. 6, according to various embodiments of the present invention.

Figure 5:
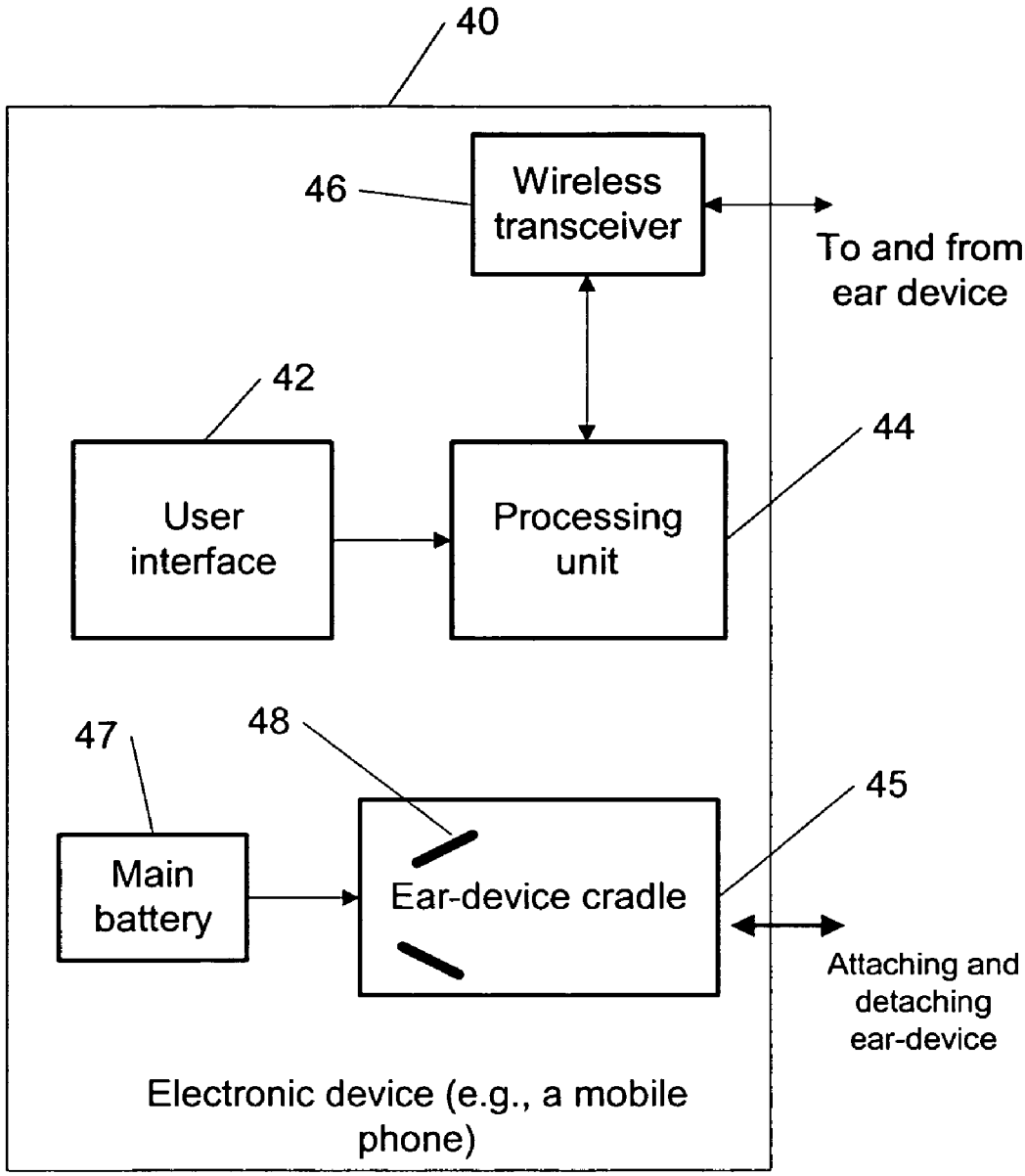
FIG. 5 is a block diagram of an external electronic device (e.g., a mobile phone) which can be a host (mother-device) for an ear-device, according to an embodiment of the present invention.

While hosted at the mother phone 40, the PHMS can serve as a phone speaker and also it can recharge its own battery 22 from the phone's main battery 47 (see FIG. 5).

According to another embodiment, a usage scenario can be that while operating as an HTM independent module, the PHMS can be easily and shortly attached to the phone to pick-up the energy (i.e., recharge the battery) and then placed again in the ear and continue, e.g., the "silent communication" mode. This operation is rather easy for the user and can be made even more frequently without drastic disturbances of the continuous communication (for example, once in 15-20 minutes).

Furthermore, openings 30 in the housing 24 (the housing 24 can be made of a hard polymeric material) to provide audio properties of the ear-device 10 in the OM. These openings 30 can also be utilized in the HTM mode for facilitating various applications (e.g., bin-aural recording) described in FIG. 6. Further, according to another embodiment of the present invention, a size of the openings 30 can be adjusted according to a need (i.e., to vary the acoustic isolation), e.g., by interposing a further cap (not shown) with a predetermined pattern of further openings with the openings 30 on a surface of the housing 24 comprising the openings 30, and continuously varying the size of the openings 30 by moving (rotating) this further cap.

FIG. 5 shows an example among others of a block diagram of an external electronic device 40 (e.g., a mobile phone) which can be a host (mother-device) for the ear-device 10, according to an embodiment of the present invention. The device 40 can comprise a user interface module 42, so the user can provide an appropriate command to facilitate an appropriate application (see FIG. 6) of the ear-device 10 (some commands can be also communicated through the user interface on the ear-device 10, if available). These commands are then forwarded to a processing unit 44 (which can be, e.g., a part of a central processing unit, CPU) and then to a wireless transceiver 46 for communicating with the ear-device 10. According to an embodiment of the present invention, the block 44 can be implemented as a software or a hardware block or a combination thereof. Furthermore, the block 44 can be implemented as a separate block or can be combined with any other standard block of the electronic device 40 or it can be split into several blocks according to their functionality.

The device 40 can also comprise an ear-device cradle 45 with the magnets 48 (described herein) for attaching and detaching the ear-device 10, and possibly a main battery 47 for recharging the battery 22 of the ear-device 10.

FIG. 6 shows an example among others of a diagram demonstrating different applications utilizing the ear-device with main modules 12, 14 and 16 (rectangles) used for different application/functionalities (ellipses) described herein, according to embodiments of the present invention.

There are a growing number of people willing to protect their hearing during a loud event (e.g., a rock concert). For this purpose, insert-ear-defenders are commonly used. According to embodiments of the present invention, this earplug can be made as a smart ear-device. The ear-device can be used for an active control of a music volume and a frequency content. The user may be able to adjust the volume so that the music is at a comfortable level. On the other hand, the tissue sensor can detect the user speech or other sounds "internally" through the human tissue vibrations, as described herein, such the user can communicate with the outside world in a noisy environment. Moreover, since there is a microphone in the device, it may also be used for recording the concert as heard by the listener bin-aurally to a mobile device in order to create a personal content. Moreover, one could possibly provide the concert to another user via a wireless link. Also, the ear-device, according to an embodiment of the present invention, can provide a decoding process (e.g., using the processing module 18) and media player capabilities. It is noted that if the hearing protecting or bin-aural recording is used, the user should have the ear-device 10 in both ears.

Moreover, sometimes it is virtually impossible to make a phone call in a noisy environment. According to embodiments of the present invention, the ear-device utilizes tissue-conduction as a means to pick-up speech with a highly reduced background noise. The in-ear speaker with ear-defender functionality can provide a clear call reproduction and high intelligibility even in such an audio-hostile environment as a concert. Other applications/use cases may include teleconferencing to enable speaker localization to both directions. In addition to advanced features, the embodiments of the present invention can also support the basic functions, such as playback in noisy conditions. It can further support other ways of communications, not only by audio but by tapping/knocking by user finger or jaw or teeth (in mouth movement), as well as a hearing aid concept, etc.

According to embodiments described herein, the user does not need to use a loud voice while communicating using a very low threshold for a signal generation which provides a silent communication capability, such that only the user's voice is transferred to the other side (surrounding noise cancellation).

Figure 7:
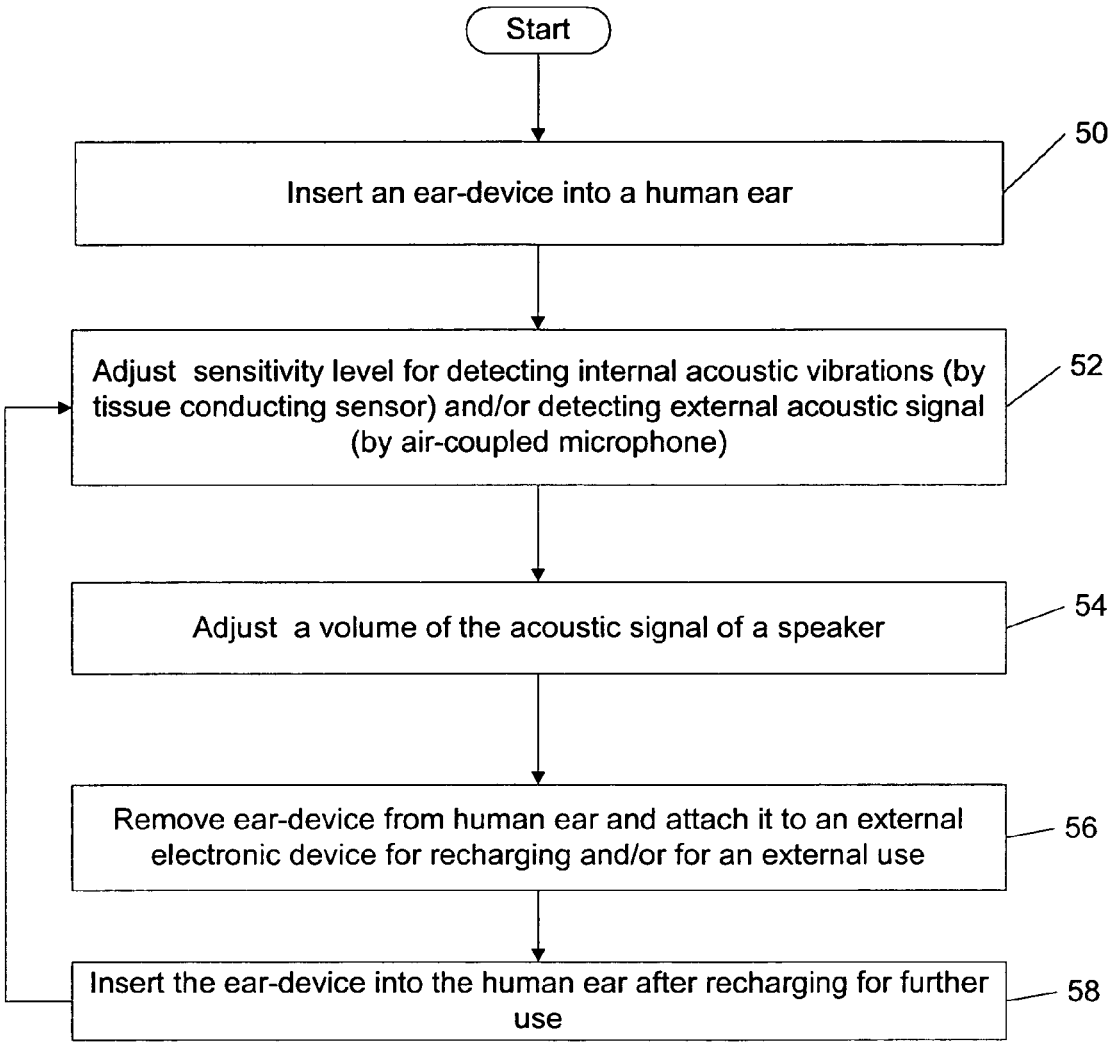
FIG. 7 is a flow chart illustrating utilization of an ear-device, according to an embodiment of the present invention.

FIG. 7 is an example of a flow chart illustrating utilization of the ear-device 10, according to an embodiment of the present invention.

The flow chart of FIG. 7 only represents one possible scenario among many others. The order of steps shown in FIG. 7 is not absolutely required, so generally, the various steps can be performed out of order. In a method according to an embodiment of the present invention, in a first step 50, the ear-device 10 is inserted into a human ear.

In a next step 52, a sensitivity level for detecting internal acoustic vibrations (by the electrode transducer/tissue conducting sensor 16) and/or detecting external acoustic vibrations (by the microphone 14) are adjusted. In a next step 54, a volume of the acoustic signal of the speaker 12 is adjusted. In a next step 56, the ear-device 10 is removed from the human ear and attached to an external electronic device 40 for recharging the battery and/or for an external use. In a next step 58, the ear-device 10 is inserted into a human ear after recharging for a further use, and the process goes back to step 52.

As explained above, the invention provides both a method and corresponding equipment consisting of various modules providing the functionality for performing the steps of the method. The modules may be implemented as hardware, or may be implemented as software or firmware for execution by a computer processor. In particular, in the case of firmware or software, the invention can be provided as a computer program product including a computer readable storage structure embodying computer program code (i.e., the software or firmware) thereon for execution by the computer processor.

Also, it is noted that various embodiments of the present invention recited herein can be used separately, combined or selectively combined for specific applications.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. An apparatus, comprising:

an electrode transducer, comprising at least one sensor, said at least one sensor comprising a surface resonator cavity with an opening sensitive to a predetermined acoustic frequency range, wherein said apparatus is configured for inserting it into a human ear for a handsfree operation and said at least one sensor is configured for detecting human tissue vibrations with said surface resonator cavity opening towards the human tissue.

2. The apparatus of claim 1, wherein said electrode transducer comprises one or more sensors of said at least one sensor with one of: a) a capacitive detection mechanism, b) a piezoelectric detection mechanism, and c) a detection mechanism utilizing miniature accelerator meters.

3. The apparatus of claim 2 wherein each of said plurality of sensors is optimized for a different acoustic frequency range.

4. The apparatus of claim 2, wherein said electrode transducer comprises a soft material between said sensors for adapting to said human ear.

5. The apparatus of claim 1, wherein said at least one sensor has a shape of a ring, line or a spiral shape.

6. The apparatus of claim 1, wherein said electrode transducer is configured for a speech detection by detecting said human tissue vibrations.

7. The apparatus of claim 1, further comprising an impedance-matching layer covering said at least one sensor for efficient and gentle acoustic coupling of said segmented sensors to said human ear.

8. The apparatus of claim 7, wherein, when said apparatus is attached to an electronic device, said at least one sensor is disengaged from a contact with said impedance-matching layer.

9. The apparatus of claim 1, further comprising:

a microphone, for detecting acoustic vibrations, wherein said apparatus is configured to adjust a sensitivity level or a sensitivity ratio of:

a) detecting said human tissue vibrations by said electrode transducer, and b) detecting said acoustic vibrations by said microphone.

10. The apparatus of claim 1, further comprising:

a speaker, for providing an acoustic signal.

11. The apparatus of claim 10, wherein said speaker is configured to adjust a volume of said acoustic signal coupled to said human ear.

12. The apparatus of claim 10, wherein said speaker is configured to adjust spectral content of said acoustic signal coupled to said human ear.

13. The apparatus of claim 9, wherein said microphone is configured to provide at least one of: a) a two-way communication in normal or noisy conditions, b) bin-aural recording, c) a hearing protection for said human ear from external noises, d) volume enhancement and equalization as a hearing aid, and e) a playback capability in said normal or noisy conditions.

14. The apparatus of claim 1, further comprises an electronic processing module for supporting functionalities of all or selected components of said apparatus.

15. The apparatus of claim 14, wherein said processing module is configured to perform a decoding process such that said apparatus is further configured to provide media player capabilities.

16. The apparatus of claim 1, further comprising at least one of: a) a battery for supporting an operation of all components of said apparatus requiring an electric power, and b) a memory for storing recorded files.

17. The apparatus of claim 1, wherein said apparatus is a part of an electronic device and is configured for detaching from said electronic device for said inserting into the human ear and for attaching back to said electronic device.

18. The apparatus of claim 17, wherein said apparatus, when attached to said electronic device, is configured to provide a further handsfree operation.

19. The apparatus of claim 17, wherein said apparatus comprises a battery and said electronic device is configured to recharge said battery when said apparatus is attached to said electronic device.

20. The apparatus of claim 1, wherein said apparatus is connected to an electronic device and said apparatus further comprising a wireless module for providing a wireless communication of said apparatus with said electronic device, or said apparatus is connected by a wire to said electronic device.

21. The apparatus of claim 20, wherein said electronic device is a wireless device, a portable communication device, a personal digital assistant or a mobile phone.

22. The apparatus of claim 1, wherein said at least one sensor comprises a plurality of ring shaped sensor segments of different diameters formed on a soft, conically shaped material.

23. An electrode transducer, comprising:

at least one sensor, which comprises a surface resonator cavity with an opening sensitive to a predetermined acoustic frequency range, wherein said at least one sensor, when inserted into a human ear for a handsfree operation, is configured to detect human tissue vibrations with said surface resonator cavity opening towards the human tissue.

24. The electrode transducer of claim 23, wherein said at least one sensor comprises one or more sensors with each comprising any one of: a) a capacitive detection mechanism, b) a piezoelectric detection mechanism, and c) a detection mechanism utilizing miniature accelerator meters.

25. The electrode transducer of claim 24 wherein each of said one or more sensors is optimized for a different acoustic frequency range.

26. The electrode transducer of claim 23, wherein said electrode transducer comprises a soft material between said sensors for adapting to said human ear and wherein said at least one sensor comprises a plurality of ring shaped sensor segments.

27. The electrode transducer of claim 23, wherein said at least one sensor has a shape of a ring, line or a spiral.

28. A method, comprising:

inserting an ear-device into a human ear for a handsfree operation, wherein said ear-device comprises: an electrode transducer comprising at least one sensor, said at least one sensor comprising a surface resonator cavity with an opening sensitive to a predetermined acoustic frequency range; and detecting by said at least one sensor human tissue vibrations with said surface resonator cavity opening towards the human tissue.

29. The method of claim 28, wherein said ear-device further comprises a microphone, and the method further comprises:

detecting acoustic vibrations using said microphone, wherein said ear-device is configured to adjust a sensitivity level or a sensitivity ratio of:

a) detecting said human tissue vibrations by said electrode transducer, and b) detecting said acoustic vibrations by said microphone.

30. The method of claim 28, wherein said ear-device further comprises a speaker providing an acoustic signal, and the method further comprises:

adjusting at least one of:

a) a volume of said acoustic signal coupled to said human ear, and b) spectral content of said acoustic signal coupled to said human ear.

31. The method of claim 28, further comprising:

taking said ear-device out of said human ear and attaching said ear-device to an electronic device for a further handsfree operation or for recharging a battery of said ear-device.

32. The method of claim 31, wherein said ear-device further comprises a wireless module, and the method further comprises:

providing a wireless communication of said ear-device with said electronic device.

33. The method of claim 29, wherein said microphone is configured to provide at least one of: a) two-way communications in normal or noisy conditions, b) bin-aural recording, c) a hearing protection for said human ear from external noises, d) volume enhancement and equalization as a hearing aid, and d) a playback capability in said normal or noisy conditions.

34. The method of claim 28, wherein said electrode transducer comprises one or more sensors of said at least one sensor with one of: a) a capacitive detection mechanism, b) a piezoelectric detection mechanism, and c) a detection mechanism utilizing miniature accelerator meters.

35. The method of claim 28, wherein said at least one sensor comprises a plurality of sensors and each of said plurality of sensors is optimized for a different acoustic frequency range.

36. The method of claim 35, wherein said plurality of sensors comprises a plurality of ring shaped sensor segments formed on a soft, conically shaped material.

37. A computer program product comprising: a non-transitory computer readable storage structure embodying computer program code thereon for execution by a computer processor with said computer program code, wherein said computer program code comprises instructions for causing an apparatus to perform the method of claim 28.

38. A system, comprising:

at least one ear-device, comprising:

an electrode transducer comprising at least one sensor, said at least one sensor comprising a surface resonator cavity with an opening sensitive to a predetermined acoustic frequency range, wherein said apparatus is configured for inserting it into a human ear for a handsfree operation and said at least one sensor is configured for detecting human tissue vibrations with said surface resonator cavity opening towards the human tissue; and an electronic device, for providing communicating acoustically generated signals to and from said ear-device.

39. The system of claim 38, further comprising:

a microphone, for detecting acoustic vibrations, wherein said apparatus is configured to adjust a sensitivity level or a sensitivity ratio of:

a) detecting said human tissue vibrations by said electrode transducer, and b) detecting said acoustic vibrations by said microphone; and a speaker, for providing an acoustic signal.

40. The system of claim 39, wherein said at least one ear-device comprises two ear-devices and the two ear-devices, when inserted into both human ears, are configured for at least one of:

a) to provide bin-aural recording, b) to provide a hearing protection for said human ears from external noises; and c) to provide an adjustable hearing protection for said human ears from external noises.

41. The system of claim 38, wherein said at least one ear-device comprises a battery for supporting an operation of all components of said ear-device requiring an electric power, and said electronic device is configured for recharging said battery.

42. The system of claim 38, wherein said at least one sensor comprises a plurality of ring shaped sensor segments formed on a soft, conically shaped material.

43. An apparatus, comprising:

transducer means, comprising at least one sensor, said at least one sensor comprising a surface resonator cavity with an opening sensitive to a predetermined acoustic frequency range, wherein said apparatus is configured for inserting it into a human ear for a handsfree operation and said at least one sensor is configured for detecting human tissue vibrations with said surface resonator cavity opening towards the human tissue.

44. The apparatus of claim 43, wherein said at least one sensor comprises a plurality of ring shaped sensor segments formed on a soft, conically shaped material.

* * * * *